United States Patent [19]

Viaggi

[11] 4,398,319

[45] Aug. 16, 1983

[54] GILL BOXES WITH ROTATING HEADS

[75] Inventor: Ferdinando Viaggi, Imola, Italy

[73] Assignee: Officine Savio S.p.A., Pordenone, Italy

[21] Appl. No.: 258,444

[22] Filed: Apr. 28, 1981

[30] Foreign Application Priority Data

Jun. 19, 1980 [IT] Italy ..... 83399 A/80

[51] Int. Cl.[3] ..... D01G 19/10

[52] U.S. Cl. ..... 19/129 R; 19/236

[58] Field of Search ..... 19/127, 128, 129 R, 19/129 A, 236, 244, 258

[56] References Cited

U.S. PATENT DOCUMENTS

| | | | |
|---|---|---|---|
| 1,497,306 | 6/1924 | Schlumberger | 19/129 R |
| 1,937,570 | 12/1933 | Holdsworth | 19/129 R |
| 2,740,996 | 4/1956 | Dudley et al. | 19/128 X |
| 4,097,964 | 7/1978 | Herubel | 19/236 |
| 4,107,821 | 8/1978 | Herubel | 19/236 X |
| 4,293,983 | 10/1981 | Van Deusen et al. | 19/129 R |

FOREIGN PATENT DOCUMENTS

| | | | |
|---|---|---|---|
| 72717 | 8/1892 | Fed. Rep. of Germany . | |
| 259689 | 6/1912 | Fed. Rep. of Germany . | |
| 1510455 | 1/1970 | Fed. Rep. of Germany . | |
| 1248933 | 11/1960 | France . | |
| 2118190 | 7/1972 | France . | |
| 818249 | 7/1968 | Italy . | |
| 242206 | 5/1958 | Spain . | |
| 291517 | 9/1963 | Spain . | |
| 386439 | 3/1971 | Spain . | |
| 413091 | 7/1934 | United Kingdom | 19/129 A |
| 431984 | 7/1935 | United Kingdom . | |
| 1369746 | 10/1974 | United Kingdom | 19/128 |

OTHER PUBLICATIONS

Melliand Textilberichte, vol. 59, Jan. 1978, Heidelberg (DE), p. 26, P. Lennox-Kerr: "Nedestabstrecke mit poiter gefuhrten Nadelstaben".

*Primary Examiner*—Louis Rimrodt

*Attorney, Agent, or Firm*—Stevens, Davis, Miller & Mosher

[57] ABSTRACT

An improved gill box with rotating heads, which comprises a plurality of needles acting on an assemblage of slivers fed substantially continuously and consists of a feeder group, a group which controls the fibers and is constituted by two heads with combs superimposed one above the other and rotating in cooperation, and a drawing group.

The gill box can comprise the following improvements: opposed rotating means to guide the ends of the combs; stationary guide-cam means cooperating in an intermediate position between the needle field and the rotating guide means; means to lubricate the rotating guides; means to feed and convey fluid under pressure into the zone of the outgoing sliver and inside every needle field; means to ensure a differentiated path of insertion of the needles into the sliver; means for a perpendicular and non-interfering withdrawal of the needles from the sliver; means for individual protrusion of the combs for better cleaning of the needles; pulling means always in phase with the rotating guide means; means to reduce angular play; and means to reduce the distance travelled by the outgoing sliver.

10 Claims, 7 Drawing Figures

20
21
10
11
12
13
14
15
16
17
18
19
22
23
24
25
27
28
31
32
33
34
35
36
37
38
39
51
53
112
116
117
118
119
124
135

FIG. 4
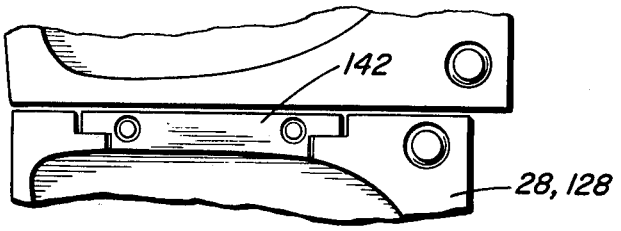
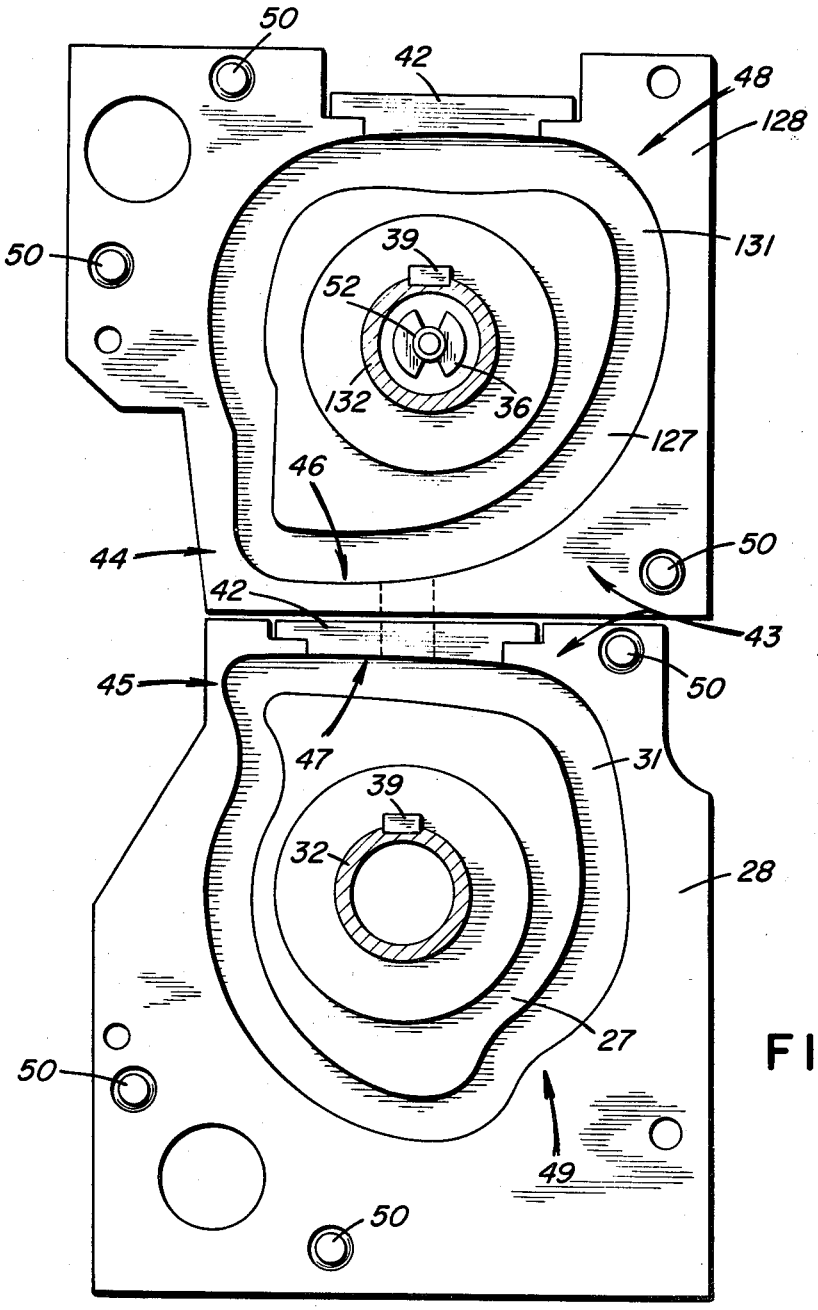
FIG. 3

GILL BOXES WITH ROTATING HEADS

This invention relates to gill boxes with rotating heads. To be more specific, the invention relates to improved gill boxes with rotating heads comprising a plurality of innovations which have a very great effect on every characteristic of the gill box itself.

Gill boxes are known which are of a type that includes at least one pair of rotating heads which pull into rotation along a pre-set course a plurality of needles acting on an assemblage of slivers fed substantially continuously. The needles penetrate into the slivers in an interlaced position so as to carry out the combing and drawing phase.

The invention relates to such a type of gill box with rotating combs as is composed substantially of: a feeder group of at least two rollers, one lower roller and one upper pressure roller, the group having the task of feeding the plurality of slivers coming from the creel or from a preceding treatment station up to the apparatus comprising the pair of heads with rotating combs; a group to control the fibers which consists of a pair of heads with combs, the heads being superimposed one above the other and rotating in opposite directions and having respectively a plurality of needles protruding from the heads; and a drawing group consisting of a pair of twin rollers together with an upper pressure roller and having the task of nipping the fibers and withdrawing them from the slivers controlled by the needles of the combing head.

The operation carried out on the slivers passing through is called the drawing operation and, as its outcome, the fibers are made parallel and the sliver itself is improved.

Many proposals for such types of gill boxes are known. Patent DE No. 72717—MEUNIER—proposes a gill box with only one plurality of needle bars running radially along slots envisaged at the ends of the bars and forming part of two motive wheels, being positioned as desired by two inner cams and an outer steel band.

The system in itself is sound, but it is not possible to understand it thoroughly, for it is impossible to judge how such a device can work at high speeds or even just for a merely suitable time.

Indeed, it is necessary to bear in mind that the resistance spring cannot work at the high frequencies generated by the successive blows of the needle bars which will take place at the high rotation speed of the grooved disks.

Moreover, the inner countercam system is hard to realize because it tends of necessity to rotate, and it is not shown how it is expected to clamp it, nor is it even indicated how the grooved disk can rotate.

Furthermore, the system in itself is just sketeched out and not capable of being applied in practice.

Patent DE No. 259689—BOUDRY—proposes a device like that of DE No. 72717 but with a different path for the needles. The remarks concerning DE No. 72717 are applicable to this patent too.

Besides, the countercam is not indicated, and therefore it is impossible to understand how the combs can be kept within the course envisaged in the lower cam.

Furthermore, it is not stated which are the movable parts and which are the stationary ones; moreover, according to the grooves as shown, the device cannot function.

Patent GB No. 431,984—ATELIERS SAINT ELOI—proposes a system of rotating needles of which the carrying bars cooperate with cranks and circular cams.

The same patent proposes a solution with a chain and with two series of needles side by side and a so-called "intersecting" solution, since it envisages two systems of rotating needles, one superimposed on the other, between which the sliver to be treated passes.

This patent envisages that the needles follow a substantially circular course, and this results in a limited combing effect as regards action, duration and results.

For this reason the patent visualizes the two heads side by side and the chain system.

Furthermore, the crank system cooperating with intersecting cams imposes rather a low maximum speed of rotation.

Moreover, the number of rows of needles which this patent allows is rather small, and the outcome is that only very long fibers can be processed. Also the system is very complex and complicated and is not suitable for working at a high speed.

Besides, as the needles are solidly fixed, it is very hard to replace them.

U.S. Pat. No. 2,740,996—DUDLEY—proposes a head with rotating needles, the needles being positioned on a plurality of bars rotating along a circumference.

A set of rollers present at the ends of the bars and cooperating with external cams positions the needles before, during and after the drawing action.

The DUDLEY invention also has a very limited working zone and too few combs to be able to function satisfactorily. Moreover, the system employed to rotate the combs is expensive, as also are the individual combs, without doubt. In addition, their replacement is very complicated.

Patent FR No. 1248933—PRINCE-SMITH—proposes a device with two huge paired wheels which have a plurality of radial slots. Within these slots can run the heads of needle bars, of which the radial displacement is conditioned by a cam and countercam.

According to this invention the tract where the sliver cooperates with the needles is devoid of the countercam, so that centrifugal force improves total penetration. This invention has a very long and irregular control zone.

The sliver has to follow a broken line consisting of two arcs and a straight line. The drawing action is presumably divided into two zones.

In view of the considerable inertia of the system, it is not suitable for working at high rotational speeds.

Patent DE OS No. 1510455—VEB—proposes a device which also comprises two opposed flanges with radial slots cooperating with needle bars shaped like an omega.

According to the description it seems understandable that this invention discards the intersecting concept and proposes expressly a control with only the lower needle field.

The presence of a cam and countercam positions the bars. However, one is not told how the bars can be kept in alignment.

For cleaning purposes a split pneumatic system is visualized, partly blowing and partly sucking, with the possibility of intersection between the two parts. The sucking operation could lead to the build-up of lumps.

In fact, in the zone where the sliver leaves and where the combs have to abandon the fibers pulled by the drawing rollers, a suction device is envisaged to aspirate the dirt, but this device increases the adherence of fibers to the combs and not their separation therefrom, thus accentuating the formation of lumps.

The description also speaks of alternated bars and bars differing from each other (but not shown). Such a system does not improve the control but instead makes it more uncertain.

The patent in itself cannot be realized and remains a mere exercise in proposals.

Patent IT No. 818249—GRAMONI—proposes some auxiliary blades for cleaning the needles. The blades cooperate with disks having multiple through millings (radial) and with lateral flanges having their circuit machined to provide a cam. The circuit cooperates with the ends of the needle bars and with the auxiliary cleaning blades.

This patent enjoins the installation of double needle bars, which are consequently heavy and unsuited to high speeds. The speed is also restricted by the radial disposition of the millings.

Patent ES No. 242206—ESTIVILL—proposes a rotating head with combs, wherein the combs are circumferentially positioned by two opposed flanges, while they are radially disposed by two external cams.

This patent has the shortcoming of comprising weak grooved flanges, since the tapering towards the middle of the grooves involves a weakening that prevents the flanges from resisting fatigue. Moreover, the proposed system of cams is imperfect and unsuitable for use.

Furthermore, severe difficulties in cleaning the inside will be met inasmuch as access thereto is impossible unless the machine is stopped and a plurality of combs is removed.

Patent ES No. 291517—ESTIVILL—proposes some improvements to the foregoing ES No. 242206. The improvements concern an improved cam system which encloses the whole course, the coupling of two rotating heads to widen the drawing field, the provision of outside cleaning means, and other aspects of little importance.

Besides being part of the already known art, all these improvements do not modify the shortcomings of ES No. 242206.

During the course of the description of ES No. 291517 the intersecting lay-out is also proposed, namely the lay-out with two mutually cooperating heads superimposed one above the other.

Patent ES No. 386439—ESTIVIL proposes, in fact, a solution with an intersecting design, as given earlier in ES No. 291517.

ES No. 386439 does not overcome the problems involved in patent ES No. 242206 but makes them worse on both rotating heads.

The present invention, therefore, contains a plurality of improvements to the known art from which it springs and which it innovates profoundly, overcoming many problems which hitherto have not been solved and which have always constituted, up to the present time, a limitation for this type of comb field.

The invention, therefore, tends to bring about many advantages, among which are the following:

the reduction of the distance travelled by the outgoing sliver, so that shorter fibers too can be processed;

the higher working speed and, therefore, the higher output of the machine without any fall in product quality, since the mechanical organs can be dimensioned so as to be stronger because the limitations imposed by the known solutions are lacking;

a lessening of vibrations, a greater continuity of feed, a better transmission of motion and an increase in mechanical efficiency, the whole being obtained with a new and simplified kinematic drive motion;

perfect alignment, phase setting and maintenance of alignment of the combs whether during processing or when the organs are open, owing to an improved system for controlling the opposed positions;

an increased life of the combs in that it is possible to dimension them to meet the stresses which they will undergo, since the design limitations imposed before are now lacking;

elimination of problems linked to the cleaning of the chambers formed by the inside space enclosed by the combs, for it is possible to keep the chambers themselves under pressure very simply.

These and other advantages which will become clear from the description hereinafter are pursued by the invention.

The invention, therefore, consists of improved gill boxes with rotating heads, which comprise a plurality of needles (teeth) acting on an assemblage of slivers fed substantially continuously, and are composed of a feed group, a fiber-control group consisting of a pair of heads with combs super-imposed one above the other and rotating in opposite directions, and a drawing group. The gill boxes are characterized by the fact that they comprise at least part of the following improvements:

rotating means to guide the combs radially at their ends, stationary guide-cam means cooperating in an intermediate position between the needle field and the rotating guide means, means to lubricate the radial rotating guides, means to feed and convey fluid under pressure into the zone of the outgoing slivers and within every needle field, means to ensure a path of differentiated insertion of the needles into the sliver, means for perpendicular departure of the needles from the sliver, means for individual protrusion of the needles so that they can be kept cleaner, means for pulling the rotating guide means in phase with the motor, means to reduce angular play, means to reduce the distance travelled by the outgoing sliver.

The innovations will be described now with the help of the attached drawings, which are provided as non-restrictive examples and in which:

FIG. 3 shows the guide cams and shafts of the gill box of FIG. 1;

FIG. 4 shows a variant of FIG. 3;

Figure 1:
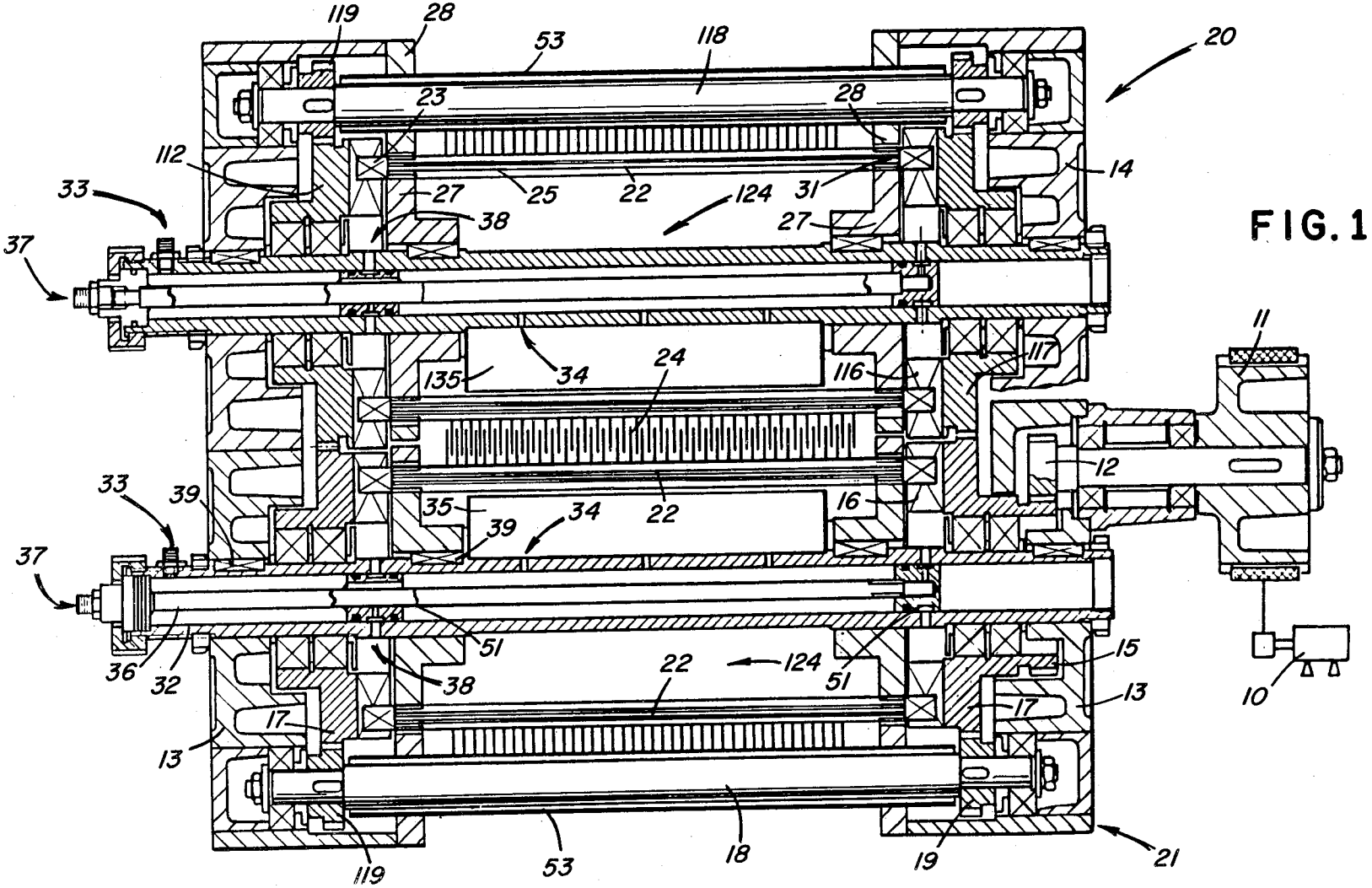
FIG. 1 shows a crosswise vertical section of an improved gill box with rotating heads.

Referring to the figures the motion is transmitted by a motor organ of any desired type 10 to the wheel 11, which sets the gear wheel 12 in rotation.

The gear wheel 12 and the wheel 11 are mounted, positioned and supported on the stationary frame 13, which is in coordinated cooperation with the frame 14, which can be moved in its upper part or be folded bookwise to facilitate access to the needle field and thus to facilitate the operations of feeding the sliver and cleaning.

The gear wheel 12 meshes with a gear wheel 15 solidly fixed to a flange 17 with the grooves or guides 16. The flange 17 has a circumferential toothing which serves to transmit motion to the coordinating bar 18 through the gear wheels 19,119 and to transmit motion to the flange 117 bearing the slots 116.

Both the flange 17 and the flange 117 are positioned in opposed pairs, so that slots 16 or 116 face each other.

The pairs of flanges 17,117 are connected to the bar 18 through gear wheels 19,119. This causes the flanges 17 and also the flanges 117 to rotate constantly in a coordinated manner.

The lay-out realized also enables the motion coming from 12 to be equally distributed not only along one path but through two different paths, namely through the shafts 18,118 and through direct transmission between the flanges 17 and flanges 117.

This direct transmission lessens the angular play between the upper and lower heads. The lower head or lower needle field is indicated as a whole with the number 21, while the upper head or upper needle field is indicated with 20.

The upper head 20 can be fully opened by being made to rotate around the axis 120, the two needle fields being rendered accessible in this way.

The play is lessened because the kinematic mechanism is simplified to consist of a simple pair of gear wheels, whereas in all known models a set of at least four gear wheels has had to be employed.

The lessening of the play and vibration leads substantially to a considerable technological improvement in the sliver produced.

The combs 22 can run in the slots 16 and 116 which comprise at their ends a substantially plane-parallel zone 23, while the needle field 24 lies in a middle position.

Between the needle field 24 and the plane-parallel end zone 23 there is the zone 25, which comprises at its corners some rounded-off areas 26 suitable for improving the working of the bar within the path imposed on it by the cams 27 and 28.

Figure 5:
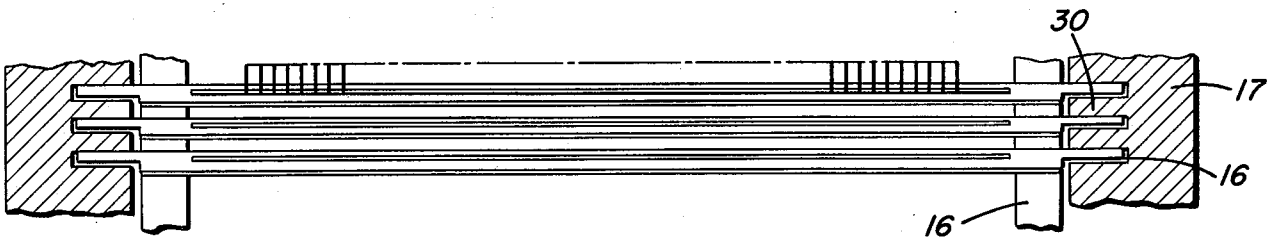
FIG. 5 shows the installation of the combs in the device according to the invention.

According to the device the combs have the needles inserted at a desired angle $\alpha$ to the lengthwise plane of the comb. The needles 29 are inserted advantageously at an inclination and are installed in the gill box in such a way that their teeth are sloped in the opposite direction to that of the forward movement of the combs. As shown in FIG. 5, this conformation enables the slots 16 to be made very small since the combs are not stressed too greatly in the transmission zone.

This conformation of the slots 16 and, more generally, the conformation of the flange 17 enable a very strong guide to be obtained between one slot 16 and its neighbor since the connection of the guide 30 to the flange 17 takes place at the rear and no longer in a zone near the middle as in the previous models.

According to the invention the slots 16 are not radial but are realized advantageously as a tangent to a concentric circle, their inclination being in phase concordance or phase difference. It has been verified advantageously (see FIG. 2) that it is more convenient for the overall phenomena to realize phase difference as regards the direction of rotation.

Hereinafter radial guides 16 are indicated in a generic and wrong meaning, the foregoing being actually meant.

As indicated, the upper head 20 and lower head 21 both consist of two facing frames which uphold and support a shaft or stiffening and connecting bar 32, which by means of keys 39 becomes solidly fixed torsionally to the frames themselves.

This stiffening bar 32 also serves to position and fix the internal cams 27, again with the employment of key means 39 or other means which are similar and produce the same technical effect.

Between the stationary frame 13 and the internal cam 27 is lodged the flange 17. The rotating flange 17 is supported in a revolving manner by means of bearings on the stiffening and connecting bar 32.

As said earlier, the stiffening and connecting bar 32 defines a plurality of holes 34 which serve to feed the fluid under pressure, which flows out within the path of the combs 22.

The plurality of holes 34 work in coordinated cooperation with the diffusers 35 so that the chamber 124 circumscribed by the combs 22 in the lower head 21 and upper head 20 can be put under slight air pressure so as to facilitate the departure of the fibers from the needles 29 in the drawing phase. This overpressure also hinders the entry of dirt into the chamber circumscribed by the plurality of combs 22.

Figure 2:
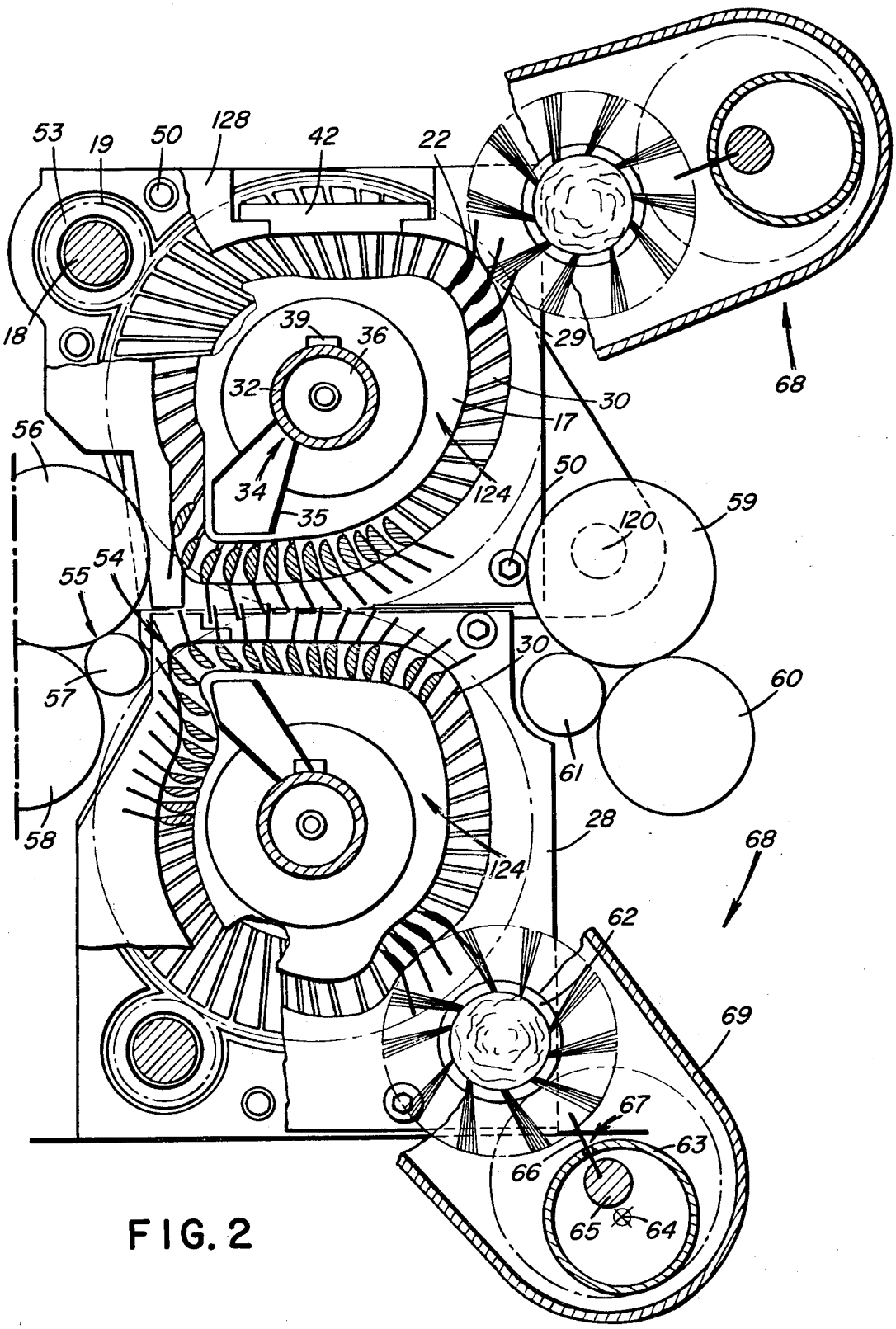
FIG. 2 shows a lengthwise vertical section of the gill box of FIG. 1.

As can be seen in FIG. 2, the diffusers 35,135 cooperate with the zones 44 and 45 (FIG. 3) where the combs leave the fibers during the drawing phase.

The conduit 36 feeds the lubricating fluid under pressure through 38 into the zone where the grooves or slots 16 or slots 16 rotate, so that the grooves 16, owing also to the centrifugal effect due to rotation of the flange 17, are lubricated constantly by the fluid under pressure.

One or more alignment elements 51 are envisaged for supporting and positioning the internal conduit 36. At least one of the alignment elements 51 comprises some through channels 52 to permit the fluid under pressure at 33 to pass to the holes 34.

Owing to the conformation of the combs 22 it is possible to increase the production speed, since the carrying bar which constitutes the comb is very strong, the fatigue stress on the tongues 23 of the combs 22 being eliminated.

As compared to the known combs, this elimination is brought about by having moved the tongues or plane-parallel areas or block 23 to an end position.

Owing to the new conformation of the combs made possible by the invention, the life of the combs 22 is greatly prolonged. This is the case because, in the zone where they cooperate with the cams 27 and 28, the combs are (or can be) considerably wider and higher and therefore have a bigger supporting surface.

This bigger supporting surface in the zone 25 of the combs 22 also leads to less wear on the cams 27 and 28.

In particular, the greater width leads to less wear on the cam 28, while the greater height leads to less wear on the slots 116.

In FIG. 3, it can be seen that the external cam 28 is not continous but is divided into two parts, 28 and 42.

In both cases the smaller part is located advantageously on the upper side and can be readily detached to enable the combs to be replaced quickly and easily. The closure insert can be fixed directly on the cam 28, as shown in FIG. 3, or the insert 42 can be fixed directly onto the frame 13 or 14 with appropriate screws, as shown in FIG. 4. In this case the insert 42 will have suitable clearances at its sides.

This constructional detail enables a channel between the external cam 28 and the insert 42 to be eliminated, and this permits the external cam 28 to be deformed freely in an elastic manner under the mechanical impulses conveyed to it by the combs 22.

According to the invention, the external cam 28 can be constructed in such a way that its natural frequency is different from the frequency of the blows of the combs 22 caused by the high speed of rotation. Advantageously the natural frequency of vibration of the external cam 28 will be greater than the frequency of the blows of the combs 22 so as to enable the external cam to be deformed under the impact of a comb 22 and to recover before the next comb strikes it.

Figure 7:
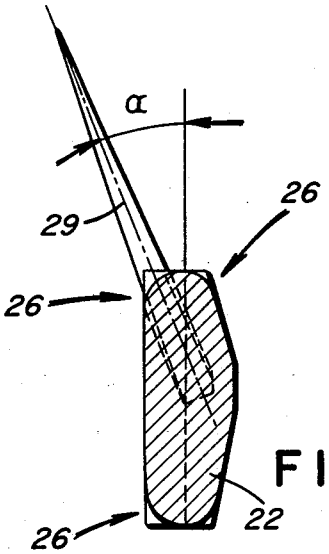
FIG. 7 shows a crosswise section of a comb according to FIG. 6.
Figure 6:
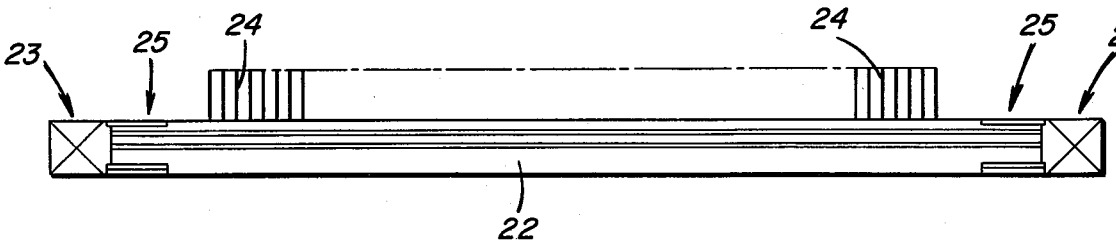
FIG. 6 shows a comb according to the invention.

So as to improve the functioning still more in the zone 25, arrangements were made to make the corners round, as shown in FIG. 7.

The setting-up bar 18,118 is covered with a fixed protective sleeve 53.

This solution makes it possible to maintain communication between the two chambers located behind the cams 27 and 28 on one side and the other and can be used advantageously to maintain a circulation of cooling liquid, which also invests the wheels 19 and the flanges 17.

As is shown in FIG. 3, the cams 27 and 28 have a special conformation, which is also a result of the studies and experiments of the author.

The zone 43, or zone of entry of the sliver, has been designed so as to enable the needles of the upper field and the needles of the lower field to be inserted into the sliver without colliding against each other.

The shaping 46 of the upper cam 128 is advantageously kept slightly curved so as to graduate the entry of the needles 29 into the sliver better, whereas the shaping 47 of the lower cam 28 is kept almost straight so as to obtain greater control of the sliver of fibers.

The exits 44 and 45 have two different conformations, which reflect differentiated requirements in the behavior of the needles 29 in respect of the sliver leaving the gill box.

The exit 44 is located slightly more to the rear and has a more rounded shape than the exit 45.

The exit 45 with its more pointed and elongated shape make possible a better control of the sliver even during its outgoing phase.

Moreover, the conformation provided for the cams 27, 28, 127 and 128, as can be seen in FIG. 3, is such as to permit a substantially perpendicular departure of the needles 29 from the sliver. In fact, the conformation given to the cams 27, 28, 127 and 128 enables a sharp variation to be obtained in the direction of speed of the combs 22 and thereby a perpendicular departure of the needles 29 from the sliver.

The positions 48 and 49 ensure, instead, individual protrusion of the combs from the grooves of the upper and lower flanges so as to make possible the cleaning by means of the known system of rotating brushes.

The system 68 of the rotating brushes can be envisaged to comprise a cover 69 a rotating brush 62 and a needle-carrying 66 oscillating bar 65, which is contained within a tubular element 63 having a plurality of holes 67 and which rotates around an offset center 64.

The feeder group shown in FIG. 2 is envisaged as having three rollers 59, 60 and 61 but could also have only two rollers. The same can be said for the drawing system at the exit, which in the example is shown with three rollers 56, 57 and 58.

The distance travelled by the outgoing sliver is given by the gap between the point 54 where the teeth 29 of the lower needle field leave the sliver and the point 55 where the rollers 56 and 57 grip the outgoing fibers. According to the invention the outgoing distance has been reduced to about 22–25 mm., and this permits any type of fiber to be processed with excellent results.

An improved gill box has been described with the adoption of a plurality of characterizing innovations. However, it is possible to vary the proportions and sizes and to add, integrate and replace parts. It is possible to couple in series two or more gill box parts according to the invention or to use only one needle field, etc. These and other variants remain within the scope of the invention.

I claim:

1. An improved gill box with rotating heads, comprising a plurality of needles that act on an assemblage of slivers fed substantially continuously, and composed of a feeder group, a group controlling the fibers which consists of a pair of heads with combs having ends and a needle field superimposed one above the other and rotating in cooperation, and a drawing group, said gill box comprising opposed rotating guide means to guide the ends of the combs, fixed guide-cam means cooperating in an intermediate position between the needle field and said rotating guide means, means to lubricate said rotating guide means, means to feed and convey fluid under pressure into an outgoing zone of the sliver and inside each needle field, means to ensure a path of differentiated insertion of the needles into the sliver, means for a perpendicular and non-interfering withdrawal of the needles from the sliver, means for individual protrusion of the combs for better cleaning of the needles, pulling means always in phase with said rotating guide means, means which reduce angular play, and drawing means positioned to reduce the outgoing travelling distance of the sliver.

2. The improved gill box as in claim 1 wherein the rotating means defines a flange body and comprise grooves separated by guides solidly fixed at their rear to the flange body, whereby said grooves advantageously lie substantially at a tangent to a circle concentric with said flange body.

3. The improved gill box as in claim 1 or 2, wherein said combs have at their ends sliding block means cooperating with said guide means defined by said rotating means, and comprise, between the needle field and said end, means to cooperate with said fixed guide-cam means.

4. The improved gill box as in claim 1 wherein said fixed guide-cam means comprise means causing a path of differentiated insertion, means to reduce the distance travelled by the outgoing slivers, upper and lower means causing individual and perpendicular withdrawal of the needles, and also means for replacement of the combs.

5. The improved gill box as in claim 1 wherein said fixed guide-cam means defines an outer part which has a frequency of vibration different from the frequency of the knocking of the combs, whereby said frequency of vibration of the outer part is greater than said frequency of the knocking of the combs.

6. The improved gill box as in claim 1 wherein said upper and lower means causing individual and perpendicular withdrawal of said needles present in the cam means together with the inclination of the guides in the rotating means, with the conformation of the zone of travel of the combs and with the inclination of the needles, whereby the upper withdrawal means lie advantageously further to the rear than the lower withdrawal means and the perpendicular withdrawal of the needles from the sliver is obtained.

7. The improved gill box as in claim 1 wherein cooperation of the rotating means with the combs and also of the cam means with the zone of travel of said combs and the rotating means of the two needle fields directly meshed together and connected to the frontally positioned reciprocal rotating means by shaft means bearing gear wheels meshed to said rotating means, enables reduction in angular play.

8. The improved gill box as in claim 1 wherein said heads define chambers for said needle fields, said chambers having diffusers mounted thereon and being kept under pressure by fluid under pressure being fed into the zone where the combs leave the sliver of fibers.

9. The improved gill box as in claim 1 wherein the cam of the lower needle field has a pointed conformation to reduce the distance travelled by the outgoing slivers.

10. The improved gill box as in claim 1 wherein said upper head defines an axis about which the upper head can be pivoted.

* * * * *